US006491095B2

(12) United States Patent
Kompanek

(10) Patent No.: US 6,491,095 B2
(45) Date of Patent: Dec. 10, 2002

(54) TRANSDUCERS, AND METHODS OF PRODUCING TRANSDUCERS, WITH CRYOGENICALLY TREATED TRANSDUCER MEMBERS

(75) Inventor: Harry W. Kompanek, Santa Barbara, CA (US)

(73) Assignee: Piezo-Sona Tool Corporation, Ventura, CA (US)

( * ) Notice: Subject to any disclaimer, the term of this patent is extended or adjusted under 35 U.S.C. 154(b) by 10 days.

(21) Appl. No.: 09/782,408

(22) Filed: Feb. 12, 2001

(65) Prior Publication Data

US 2002/0108749 A1 Aug. 15, 2002

(51) Int. Cl.[7] ..... E21B 43/25

(52) U.S. Cl. ..... 166/249; 166/177.6

(58) Field of Search ..... 166/248, 249, 166/270, 177.6, 252.1, 272.6, 275, 263

(56) References Cited

U.S. PATENT DOCUMENTS

| | | | | | |
|---|---|---|---|---|---|
| 3,583,677 | A | * | 6/1971 | Phillips | 166/177 X |
| 4,185,691 | A | * | 1/1980 | Tubin et al. | 166/250 |
| 4,774,427 | A | * | 9/1988 | Plambeck | 310/321 |
| 5,017,281 | A | * | 5/1991 | Sadeghi et al. | 208/390 |
| 5,132,942 | A | * | 7/1992 | Cassone | 367/159 |
| 6,186,228 | B1 | * | 2/2001 | Wegener et al. | 166/249 |
| 6,241,019 | B1 | * | 6/2001 | Davidson et al. | 166/249 |
| 6,238,102 | B1 | * | 12/2001 | Dean | 166/248 |

* cited by examiner

*Primary Examiner*—Frank S. Tsay
(74) *Attorney, Agent, or Firm*—Fulwider Patton, et al.; Ellsworth R. Roston

(57) ABSTRACT

A transducer provides (a) increased magnitudes of vibrations without cracking and (b) increased power to the transducer, in response to alternating voltages, for producing transducer vibrations with increased magnitudes. A polycrystalline ceramic (e.g. polycrystalline lead titanate or polycrystalline lead zirconate) has a looped configuration with a gap and has properties of vibrating upon an introduction of an alternating voltage, preferably rich in harmonies, to the ceramic. The ceramic is cryogenically treated as by initially reducing its temperature to approximately −100° C., then disposing the ceramic in liquid nitrogen and thereafter gradually increasing its temperature to approximately room temperature. This increases the dielectric strength of the ceramic by prestressing the ceramic, thereby providing for the ceramic to receive increased voltages without cracking. An alternating voltage rich in harmonics (e.g. square wave voltage) may be applied to the ceramic. The transducer also includes a support member (e.g. steel or aluminum) having a looped configuration and having a gap aligned with the ceramic gap and having properties of vibrating with the ceramic. The support member envelopes, and is attached to, the ceramic. The support member may have a uniform thickness around its periphery or a progressively increasing thickness with progressive distances in opposite directions from the gap to enhance its ability to withstand cracking when subjected to vibrations. In other embodiments, a plurality of transducers may be combined in different ways to form a transducer assembly with enhanced power characteristics.

61 Claims, 4 Drawing Sheets

FIG. 3a

| WAVEFORM | FREQUENCY-HERTZ | VOLTAGE | CURRENT | PWR. IN | SOUND METER OUTPUT |
|---|---|---|---|---|---|
| SINE | 200 | 100 | <10ma | <1 WATT | <72 db |
| SQUARE | 200 | 100 | 130ma | 13 WATTS | 93 db |
| SINE | 250 | 100 | 10ma | 1 WATT | <72 db |
| SQUARE | 250 | 100 | 145ma | 14.5 WATTS | 93 db |
| SINE | 400 | 100 | 20ma | 2 WATTS | <72 db |
| SQUARE | 400 | 100 | 185ma | 18.5 WATTS | 97 db |
| SINE | 450 | 100 | 25ma | 2.5 WATTS | <72 db |
| SQUARE | 450 | 100 | 190ma | 19 WATTS | 96 db |
| SINE | 550 | 100 | 25ma | 2.5 WATTS | <72 db |
| SQUARE | 550 | 100 | 220ma | 22 WATTS | 99 db |
| SINE | 600 | 100 | 50ma | 5.0 WATTS | 92 db |
| SQUARE | 600 | 100 | 220ma | 22 WATS | 100 db |
| SINE | 700 | 100 | 50ma | 5.0 WATTS | 84 db |
| SQUARE | 700 | 100 | 245ma | 24.5 WATTS | 106 db |
| SINE | 800 | 100 | 50ma | 5.0 WATTS | 100 db |
| SQUARE | 800 | 100 | 225ma | 22.5 WATTS | 106 db |
| SINE | 900 | 100 | 50ma | 5.0 WATTS | 96 db |
| SQUARE | 900 | 100 | 280ma | 28 WATTS | 108 db |
| SINE | 950 | 100 | 50ma | 5.0 WATTS | 86 db |
| SQUARE | 950 | 100 | 260ma | 26 WATTS | 98 db |

FIG. 3b

| WAVEFORM | FREQUENCY-HERTZ | VOLTAGE | CURRENT | PWR. IN | SOUND METER OUTPUT |
|---|---|---|---|---|---|
| SINE | 600 | 200 | 50ma | 10 watts | 90 db |
| SQUARE | 600 | 200 | 230ma | 46 watts | 99 db |
| SINE | 700 | 200 | 50ma | 10.0 watts | 86 db |
| SQUARE | 700 | 200 | 250ma | 50 watts | 107 db |
| SINE | 800 | 200 | 50ma | 10.0 watts | 102 db |
| SQUARE | 800 | 200 | 240ma | 48 watts | 106 db |
| SINE | 900 | 200 | 50ma | 10 watts | 98 db |
| SQUARE | 900 | 200 | 285ma | 57 watts | 107 db |

FIG. 7
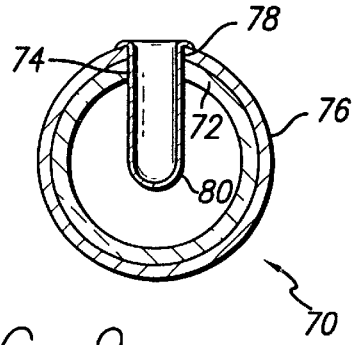
FIG. 8
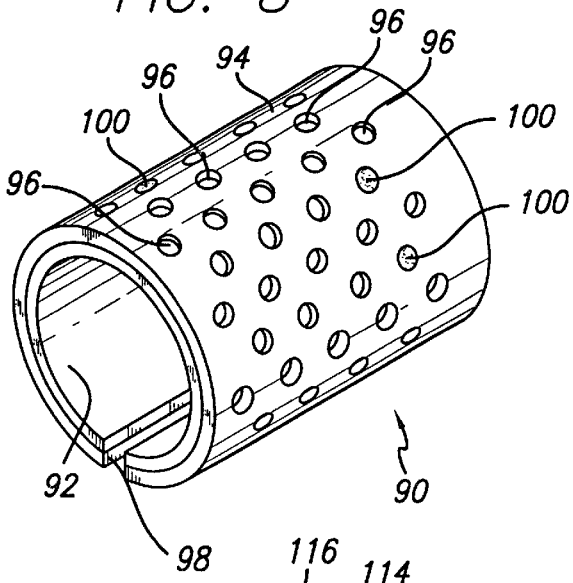
FIG. 9
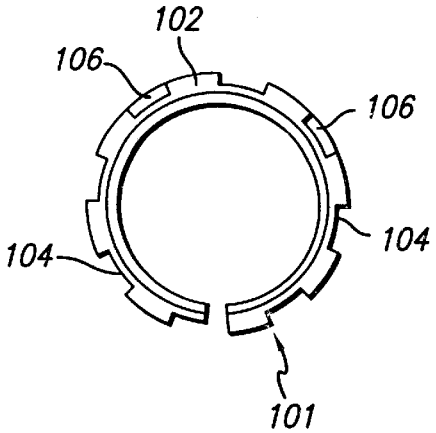
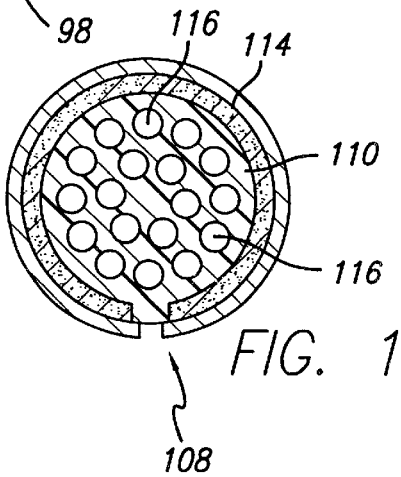
FIG. 10
FIG. 12
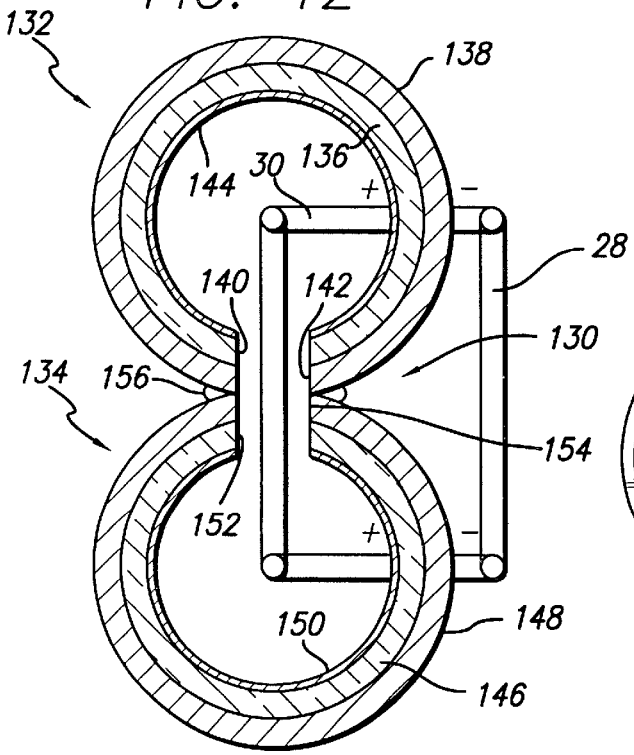
FIG. 11
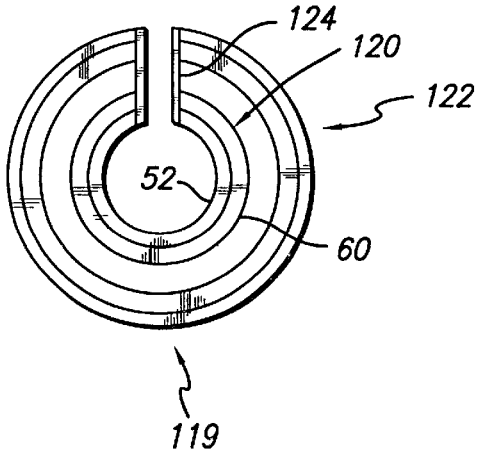

TRANSDUCERS, AND METHODS OF PRODUCING TRANSDUCERS, WITH CRYOGENICALLY TREATED TRANSDUCER MEMBERS

This invention relates to transducers. More particularly, the invention relates to transducer assemblies which apply increased amounts of power to the earth around the transducer assemblies to obtain an enhanced recovery of oil from the earth.

BACKGROUND OF PREFERRED EMBODIMENTS OF THE INVENTION

As oil wells now in existence are being depleted, it has become increasingly difficult to discover new sources of oil and to recover the oil from these new sources. The oil being discovered is generally at increased depths under the earth's surface. Furthermore, the oil is often viscous and is disposed at positions under the earth's surface where it cannot be easily recovered. For these and other reasons, it has become increasingly difficult to recover as much oil from the earth as would otherwise be desired.

Increased forces have had to be applied by the transducers to the earth around the transducers to separate the oil and recover the separated oil from the earth. The problems have been magnified because the characteristics of the earth, even at closely spaced positions, vary. These variable characteristics, even at closely spaced positions, prevent the transducers from operating efficiently to separate and recover the oil from positions below the earth's surface.

Transducers now in use are disposed below the earth's surface and are vibrated to separate the oil from the earth and to recover the separated oil. The recovery of the oil is facilitated by increasing the amount of power applied to the transducers, thereby increasing the amplitude of the transducer vibrations. Application Ser. No. 09/746,849 discloses a system for increasing the amount of power applied to the transducers by introducing an alternating voltage rich in harmonics (e.g. a square ware voltage) to the transducer. Attempts are being made to increase the ability of the transducers to provide enhanced magnitudes of vibrations without cracking.

BRIEF DESCRIPTION OF PREFERRED EMBODIMENTS OF THE INVENTION

In a preferred embodiment of the invention, a transducer has enhanced abilities to provide (a) increased magnitude of vibrations without cracking and (b) increased power to the transducer, in response to alternating voltages, for producing transducer vibrations with increased magnitudes.

The transducer includes a ceramic (e.g. polycrystalline lead titanate or polycrystalline lead zirconate) having a looped configuration with a gap and having properties of vibrating upon an introduction of an alternating voltage, preferably rich in harmonics, to the ceramic. The ceramic is cryogenically treated as by initially reducing its temperature to approximately −100° C., then disposing the ceramic in liquid nitrogen and thereafter gradually increasing its temperature to room temperature. This increases the dielectric strength of the ceramic by prestressing the ceramic, thereby providing for the ceramic to receive increased voltages without cracking.

A support member (e.g. steel or aluminum) having a looped configuration, and having a gap aligned with the ceramic gap and having properties of vibrating with the ceramic envelopes and is attached to, the ceramic. The support member may have a substantially uniform thickness around its periphery or a progressively increasing thickness with progressive distances in opposite directions from the gap to enhance its ability to withstand cracking when subjected to vibrations. Instead of providing a ceramic in a loop, the cryogenically treated ceramic may be sectionalized in another embodiment and the sections may be stacked in the space between the opposite legs of the support and attached at their opposite ends to the support legs. In other embodiments a plurality of transducers may be combined in different ways to form a transducer assembly with enhanced power characteristics.

BRIEF DESCRIPTION OF THE DRAWINGS

In the drawings:

FIGS. 3*a* and 3*b* are charts indicating parameters including voltage and current amplitudes and power into the transducer, and the sound wave pressure output from the transducer at the fundamental frequency and harmonics and overtones of the fundamental frequency, for a sine waveform voltage and for the harmonic-rich voltage shown in FIG. 2 when the peak amplitude of the voltage is 100 volts (FIG. 3*a*) and is 200 volts (FIG. 3*b*);

FIG. 7 is a sectional view of a fifth transducer which includes the cryogenically treated ceramic as the transducer member, and which may include the harmonic-rich alternating voltage shown in FIG. 2, to obtain still another preferred embodiment of the invention for providing an enhanced recovery of oil from the earth at a position below the earth's surface;

FIG. 8 is a sectional view of a sixth transducer which includes the cryogenically treated ceramic as the transducer member, and which may include the harmonic-rich alternating voltage shown in FIG. 2, to obtain a still further preferred embodiment of the invention for providing an enhanced recovery of oil from the earth at a position below the earth's surface;

FIG. 9 is a sectional view of a seventh transducer which includes the cryogenically treated ceramic as the transducer member, and which may include the harmonic-rich alternating voltage shown in FIG. 2, to obtain another preferred embodiment of the invention for providing an enhanced recovery of oil from the earth at a position below the earth's surface;

FIG. 10 is a sectional view of an eighth transducer which includes the cryogenically treated ceramic as the transducer member, and which may include the harmonic-rich alternating voltage shown in FIG. 2, to obtain still another preferred embodiment of the invention for providing an enhanced recovery of oil from the earth at a position below the earth's surface.

FIG. 11 is a sectional view of a ninth transducer which includes the cryogenically treated ceramic as the transducer member, and which may include the harmonic-rich alternating voltage shown in FIG. 2, to obtain an additional preferred embodiment of the invention for providing an enhanced recovery of oil from the earth at a position below the earth's surface;

FIG. 12 is a sectional view of a tenth transducer which includes the cryogenically treated ceramic as the transducer member, and which may include the harmonic-rich alternating voltage shown in FIG. 2, to obtain still another additional preferred embodiment of the invention for providing an enhanced recovery of oil from the earth at a position below the earth's surface.

DETAILED DESCRIPTION OF PREFERRED EMBODIMENTS OF THE INVENTION

Figure 1:
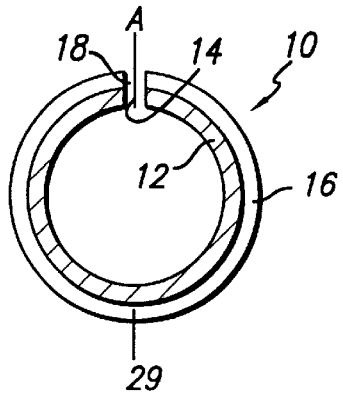
FIG. 1 is a sectional view of a first transducer constituting a preferred embodiment of the invention for recovering oil in the earth from a position below the earth's surface, the transducer including a cryogenically treated ceramic for enhancing the operating characteristics of the transducer.

FIG. 1 shows a transducer, generally indicated at 10, which constitutes a preferred embodiment of the invention. A transducer with features similar to some of the features in the transducer 10 is shown in a number of prior art patents including U.S. Pat. No. 4,774,427 (FIG. 2) issued to Eric D. Plambeck on Sep. 27, 1988 for a Downhole Oil Well Vibrating System and assigned of record to Piezo Sona-Tool Corporation, the assignee of record of this application. The transducer 10 includes a transducer member 12 preferably having a looped (e.g. cylindrical) configuration. The transducer member 14 may be made from a suitable material such as a material having piezoelectric properties. For example, the transducer 10 may be made from a ceramic such as a polycrystalline, polycrystalline lead titanate, a polycrystalline lead zirconate, and lead zirconium titanate. An opening or gap 14 is provided in the transducer member 12, preferably in a radial direction.

The transducer member 12 is subjected to a cryogenic treatment to increase the dielectric strength of the material. This in turn provides for the transducer member 12 to be operated at higher voltages than the voltages at which the transducer member can be operated when it is not treated cryogenically. The ability of the cryogenically treated member 12 to operate at elevated voltages applied to the transducer member causes increased forces to be applied to the earth surrounding the transducer 10, thereby enhancing the separation of the oil from the surrounding earth and the recovery of the separated oil from the earth.

Applicant has cryogenically treated ceramic materials used to make the transducer member 12 and then has conducted tests to substantiate that the cryogenically treated transducers 10 are able to operate at elevated voltages applied to the cryogenically treated transducer members 12. The elevated voltages are higher than the voltages at which similar transducers have been able to operate in the prior art. For example, applicant has initially provided discs with an outer diameter of approximately one inch (1") and with a thickness of approximately ten mils (0.010"). The discs were gradually cooled in an environmental chamber to approximately −100° C. and were then transferred to liquid nitrogen to cool to a temperature approximately, or at least approaching, the temperature of the liquid nitrogen.

A voltage was applied to the discs in increments of approximately one kilovolt (1 kV.) to a maximum voltage of approximately ten kilovolts (10 kV.) and the voltage of approximately ten kilovolts (10 kV.) was maintained on the discs for approximately one hour (1 hr). The discs were then cooled gradually to room temperature. The capacitance of the discs was checked and the dielectric constant was found to be approximately six percent (6%) higher than if the discs had not been cryogenically treated as described above.

The discs were then placed in vegetable oil at room temperature. A voltage in increments of approximately one kilovolt (1 kV.) was again applied to the disc to a maximum of approximately ten kilovolts (10 kV.). In a total of ten (10) discs, three had short circuits at approximately six kilovolts (6 kV.); one (1) shorted at approximately eight kilovolts (8 kV.); and six (6) remained operative at the voltage of approximately ten (10) kilovolts (10 kV.) for a period of approximately five (5) minutes.

The test was repeated with additional discs constructed in the same manner as specified above for the cryogenically treated discs but without any cryogenic treatment of the additional discs. All had short circuits at voltages between approximately three kilovolts (3 kV.) and five kilovolts (5 kV.). This is considerably less than the voltages applied to the discs specified in the previous paragraph. In production in the prior art, the discs have been previously polarized at voltages between approximately eight hundred volts (800 V.) and one kilovolt (1 kV.).

The tests specified above were repeated with six (6) cylinders each having an outer diameter of approximately two inches (2") and a wall thickness of approximately an eighth of an inch (⅛") and with a length of approximately two and one half inches (2.5"). Only one of the cylinders could be treated at any instant because of the limited volume of the environmental chamber and a violent pyroelectric effect when the cylinder was immersed in liquid nitrogen. A maximum voltage of approximately fifteen kilovolts (15 kV.) was applied to each cylinder for approximately one (1) hour in increments of approximately one kilovolt (1 kV.). An increased voltage could be applied to the cylinders because the thickness of the cylinders was increased. Two (2) of the cylinders shattered at a voltage of approximately twelve kilovolts (12 kV.). The other four (4) cylinders remained constant at a voltage of approximately 15 kilovolt (15 kV.) for approximately five (5) minutes.

Four (4) slotted cylinder transducers were assembled from the cylinders specified in the previous paragraph. Two (2) transducers of the same construction were assembled from cryogenically untreated ceramics. When the transducers were immersed in odorless mineral spirits (OMS) marketed by Exxon and were electrically powered at their resonant frequency, all of the units started to cavitate at about one hundred and fifty volts (150 V.). The voltage was then increased in the units in an attempt to break the ceramics. The cryogenically untreated ceramics in the two (2) transducers respectively cracked at a position approximately 180° from the gap at voltages of approximately five hundred volts (500 V.) and five hundred and fifty volts (550 V.). The cryogenically treated ceramics in the four (4) transducers operated satisfactorily to eight hundred volts (800V). This was the limit of the amplifier used.

All of the tests specified above were experimental. These tests indicated quite clearly that the transducer 10 could be operated at increased voltages without cracking when they were cryogenically treated.

A support member 16 is provided with a looped (e.g. cylindrical) configuration corresponding to the looped (e.g. cylindrical) configuration of the transducer member 12 in FIG. 1. The support member 16 is disposed in enveloping relationship to the cryogenically treated transducer member 12 and is suitably attached as by a suitable bonding agent to the cryogenically treated transducer member 12 along the common surface between the transducer member and the support member. The support member 16 is preferably made from a material which provides support to the cryogenically treated transducer member 12 and which vibrates in accordance with the vibrations of the transducer member. Preferably this material may be a steel, aluminum or a graphite epoxy.

Figure 4:
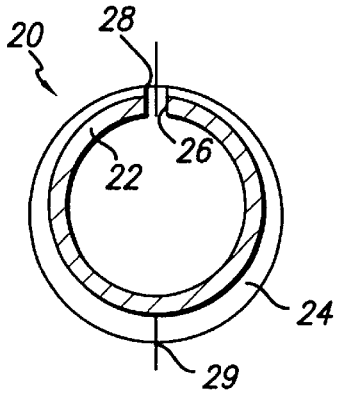
FIG. 4 is a sectional view of a second transducer which includes the cryogenically treated ceramic as the transducer member, and which may include the harmonic-rich voltage shown in FIG. 2, to obtain a preferred embodiment of the invention for providing an enhanced recovery of oil from the earth at a position below the earth's surface.

FIG. 4 illustrates an embodiment of another transducer, generally indicated at 20, constituting another preferred embodiment of the invention. A transducer 20 includes a cryogenically treated transducer member 22 and a support member 24. The cryogenically treated transducer member 22 and the support member 24 may have substantially the construction specified above for the embodiment shown in FIG. 1. The cryogenically treated transducer member 22 and the support member 24 are respectfully provided with openings or gaps 26 and 28. The gaps 26 and 28 may respectively correspond to the gaps 14 and 18 in the embodiment shown in FIG. 1. A transducer similar to the transducer 20 is shown in FIG. 3 of U.S. Pat. No. 4,774,427. However, the transducer shown in FIG. 3 of U.S. Pat. No. 4,774,427 does not include a transducer member which is cryogenically treated.

The thickness of the support member 24 in the transducer 20 is progressively increased with progressive distances from the opening or gap 28. The thickness of the support member 24 at each position may be related to the magnitude of the stress experienced by the support member 24 at that position. In this way, the maximum thickness of the support member 24 is at a position 29 diametrically opposite the opening or gap 28. By providing progressive increases in the thickness of the support member 24 in this manner, the amplitude of the vibrations in the cryogenically treated transducer member 22 may be significantly increased without cracking or otherwise damaging the cryogenically treated piezoelectric transducer member 22 on the support member 24.

Figure 2:
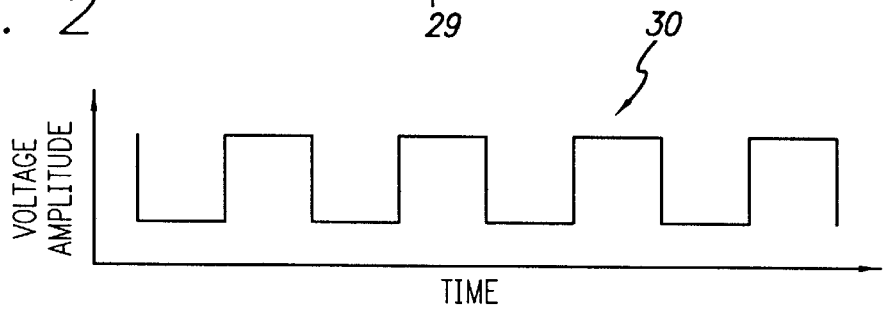
FIG. 2 is a waveform of an alternating voltage (e.g. a square ware voltage preferably) included, with the transducer shown in FIG. 1, in a preferred embodiment of the invention and applied to the transducer to obtain an optimal recovery of oil from the earth, the alternating voltage including a fundamental frequency and being rich in harmonics.

FIG. 2 illustrates a voltage waveform, generally indicated at 30, which may be applied to the transducer member 12 in FIG. 1 or to the transducer member 22 in FIG. 4. The voltage waveform 30 has a fundamental frequency which corresponds to the frequency at which the transducer 10 in FIG. 1 or the transducer 20 in FIG. 2 vibrates when the transducer is disposed in air and alternating voltage is applied to the transducer member in the transducer. For reasons which will be described in detail subsequently, the voltage waveform 30 is rich in harmonics. For example, the voltage waveform 30 may constitute a square wave.

Applicant has made a series of tests, using different voltage waveforms, to evaluate the operation of applicant's transducers such as the transducers shown in FIGS. 1 and 4. Applicant utilized alternating voltages having sine waveforms, triangular waveforms and square waveforms (such as shown in FIG. 2) in these tests. In these tests, the sine waveform, the triangular waveform and the square waveform had substantially the same peak amplitude. To applicant's surprise, the alternating voltage having a square waveform generated increases in power output from the transducers that were orders of magnitude greater than the power output obtained from the voltage the sine and triangular waveforms. For example, this increase in power output was as much as ten (10) times or fifteen (15) times greater than the power output generated by the voltages with the sine and triangular waveforms.

The increase in the power output of the transducer 10 and 20 is dependent upon how far the transducer is operating in the earth from the resonant frequency of the transducer (when disposed in air). The power increase of the transducer is extended over a wide frequency range of harmonics and overtones compared to the power generated in the earth by the transducer at the fundamental resonance frequency of the transducer (this fundamental resonance frequency being determined when the transducer is operated in air). The increase in power output over the significant range of harmonics and overtones significantly increased the apparent bandwidth when the transducer operated in the earth as the impedance provided by the earth varied at different positions in the earth.

The transducers tested had either a two inch (2") diameter or a four inch (4") diameter. They had a relatively high mechanical Q. For example, the transducers had a mechanical Q in the range of fourteen (14) to eighteen (18). The tools were internally pressurized to one hundred pounds per square inch (100 psi) and were hung inside a plastic test tank with a twelve inch (12") outer diameter. A sound meter was placed on the outside of the tank with the microphone tangent to the surface of the test tank. Since applicant had no way of measuring absolute values in water and no way of correcting for reflection and standing waves over the frequency range of the harmonics and overtones of the fundamental frequency, the most reliable and repeatable method of testing for sine waveform voltage testing and square waveform voltage testing appeared to be the method of testing with a sound meter.

As will be seen from the chart shown in FIG. 3*a*, when a voltage with a square waveform was applied to the transducer, the high mechanical Q of the transducer produced many powerful harmonics and overtones that were either non-existent or greatly attenuated when the transducer was powered with an alternating voltage with a sine waveform. This may be seen from the different columns in the chart shown in FIG. 3*a*. The first column in FIG. 3*a* indicates the characteristics of the voltage waveform and indicates "sine" (sine wave) for first alternate rows and "square" (square wave) for the other alternate rows. The second column in FIG. 3 indicates the frequency (in hertz) of one of the components in the waveform. As will be seen, the fundamental frequency is 200 hertz.

The third ($3^{rd}$) column in FIG. 3*a* indicates the peak amplitude value of the input voltage to the transducer. As will be seen, the current in the transducer member is considerably greater at the fundamental frequency, the harmonics and the overtones for the square wave voltage than for the sine wave voltage. Furthermore, the current at the fundamental frequency of two hundred (200) hertz for the square wave voltage exceeded the current at the fundamental frequency for the sine wave voltage. The current at the harmonic and overtone frequencies for the square wave voltage in many cases exceeded the current at the same harmonic and overtone for the sine wave voltage. The fourth ($4^{th}$) column in FIG. 3*a* indicates the current in the transducer in milliamperes.

The fifth ($5^{th}$) column in FIG. 3*a* is designated as "power in". It indicates the power input to the transducer. It will be noted that the power input to the transducer is considerably greater at the fundamental frequency, the harmonics and the overtones for the square waveform than for the sine waveform. The sixth ($6^{th}$) column in FIG. 3*a* indicates the power output from the transducer, as measured by the sound pressure of the output waves. As will be seen the power output is much greater at the fundamental frequency, the harmonics and the overtones for the square wave voltage than for the sine wave voltage. This is through a range of frequencies between the fundamental frequency of 200 hertz and an overtone of 950 hertz. This is consistently true of every frequency between the range of 200–950 hertz.

FIG. 3*b* is a chart similar to that shown in FIG. 3*a* but involves a peak voltage of 200 volts for the sine wave voltage and the square wave voltage. The six (6) columns in FIG. 3*b* have the same headings as the headings for the corresponding columns shown in FIG. 3*a*. The chart shown in FIG. 3*b* extends only between 600 hertz and 900 hertz. The reason is that no a signal could be obtained for the sine wave voltage between 200 hertz and 550 hertz. In this frequency range, the sound meter had a reading of 73 db, which corresponded to the ambient noise level in the test facility. However, the square wave over the frequency range of 200–550 hertz did respond significantly over this frequency range as indicated by sound pressure readings of 97 db to 101 db for the different frequencies. Furthermore, significant increases in power output occurred for the square wave voltage in the harmonics and overtones over the frequency range of 600 hertz to 900 hertz in comparison to the power output for the sine wave voltage over this range of frequencies.

The reasons for the differences in the output from the transducer at the harmonics and overtones between the application of a square wave voltage and a sine wave voltage to the transducer, through an extended frequency range of 200 hertz to 950 hertz, are not known. However, the differences in the power output at the harmonics and overtones through an extended frequency range such as 200–950 hertz are surprising and unexpected. This is particularly surprising and unexpected in view of the large range of frequencies through which the large power outputs are obtained. Such differences may result from changes in the characteristics of the earth at different positions below the earth's surface. The differences are even more surprising and unexpected at overtones of the fundamental frequency than at harmonics of the fundamental frequency. As will be seen, the power output at the overtone frequencies for the square wave voltage often exceeded the power output at the harmonic frequencies for the square wave voltage and considerably exceeded the power output at the fundamental frequency.

The input of an alternating voltage rich in harmonics (e.g. square wave voltage) is disclosed and claimed in application Ser. No. 09/746,849. This application discloses and claims transducers with cryogenically treated transducer members, and methods of providing transducers with cryogenically treated transducer members, and also discloses and claims the combination of transducers with cryogenically treated transducer members and the introduction of voltages rich in harmonics (e.g. square wave voltages) to the cryogenically treated transducer members.

Figure 5:
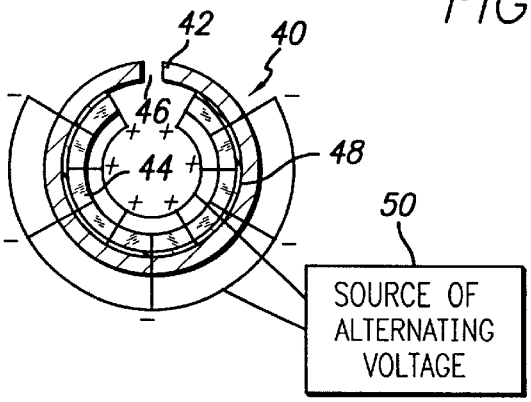
FIG. 5 is a sectional view of a third transducer which includes the cryogenically treated ceramic as the transducer member, and which may include the harmonic-rich voltage shown in FIG. 2, to obtain another preferred embodiment of the invention for providing an enhanced recovery of oil from the earth at a position below the earth's surface.

FIG. 5 is an enlarged sectional view of another preferred embodiment, generally indicated at 40, of a transducer to which a harmonic-rich alternating voltage such as illustrated at 30 in FIG. 3 may be applied to obtain a preferred embodiment of this invention and in which the transducer elements are cryogenically treated. A transducer similar to the transducer 40 is shown in FIG. 1 of U.S. Pat. No. 4,651,044 which issued to applicant on Mar. 17, 1987, for an "Electroacoustical Transducer".

The transducer 40 in FIG. 5 includes a support member 42 corresponding to the support member 16 in FIG. 1 or corresponding to that shown in any of the other Figures of this application. A plurality of cryogenically treated sectionalized transducer elements 44 are arranged within the support member 42 in abutting and progressive relationship to one another and in abutting relationship to the inner wall of the support member. The cryogenically treated sectionalized transducer elements 44 are preferably provided with substantially equal circumferential lengths and thicknesses and are disposed in symmetrical relationship to the support member 42, and particularly in symmetrical relationship to an opening or gap 46 in the support member. The opening or gap 46 corresponds to the opening or gap 18 in the support member 16 in FIG. 1.

The cryogenically treated sectionalized transducer elements 44 may be made from a suitable ceramic material (e.g. lead titanate, lead zirconate and lead zirconium titanate) having piezoelectric properties. The cryogenically treated sectionalized transducer elements 44 are bonded to the inner wall of the support member 42 by any suitable adhesive 48 so as to follow the circumferentially disposed inner wall of the support member. The adhesive 48 has properties of insulating the cryogenically treated sectionalized elements 44 from the support member 42. The cryogenically treated sectionalized transducer elements 44 are preferably polarized circumferentially rather than through the wall thickness.

Circumferential polarization of the cryogenically treated sectionalized transducer elements 44 provides the transducer 40 with a relatively high coupling co-efficient such as a coefficient of at least fifty percent (50%). This high coupling coefficient facilitates the production of a good bond between the cryogenically treated sectionalized transducer elements 44 and enhances efficiency in the conversion of electrical energy to acoustical energy in the transducer elements. Alternating voltages are introduced to the cryogenically treated sectionalized elements 44 from a source 50. The introduction of such signals to the elements 44 in the plurality may be provided on a series basis or a parallel basis. The alternating voltages from the source 50 are preferably harmonic-rich (e.g. square wave voltages) as indicated at 30 in FIG. 2.

When harmonic-rich alternating voltages are introduced from the source 50 to the cryogenically treated sectionalized transducer elements 44, the voltages produce vibrations of the sectionalized transducer elements. These vibrations in turn produce vibrations in the support member 42, which functions in the manner of a tuning fork. The frequency of these vibrations is dependent somewhat upon the characteristics, such as the thickness and diameter, of the support member 42. As a result, for a support member 42 of a particular diameter, the resonant frequency of the transducer 40 may be primarily controlled by adjusting the thickness of the support member 42. This resonant frequency constitutes the fundamental frequency of the alternating voltage from the source 50.

The embodiment shown in FIG. 5 has certain important advantages. It provides a conversion of electrical energy to acoustical energy at low frequencies such as frequencies in the order of two kilohertz (2 kHz) or less. The fundamental frequency of the acoustical energy can be precisely controlled. Furthermore, the transducer 40 provides a relatively large amount of energy since the support member 42 can be provided with sturdy characteristics by the selection of a particular metal such as steel and by the provision of an adequate thickness for the support member. In addition, the use of the cryogenically treated sectionalized transducer elements 44 inhibits any cracking of the support member 42 by the cryogenically treated sectionalized transducer elements 44 even when the elements are subjected to a considerable amount of electrical energy.

The formation of the transducer 40 from the support member 42 and the cryogenically treated sectionalized elements 44 is further advantageous since the efficiency in the transfer of energy from electrical energy to mechanical movement is materially enhanced over that obtained in the prior art. For example, the embodiment of FIG. 5 obtains an efficiency of well in excess of fifty percent (50%) in the conversion of electrical energy to mechanical movement. This is in contrast to efficiencies of approximately thirty-one percent (31%) from similar conversions in the prior art.

Figure 6:
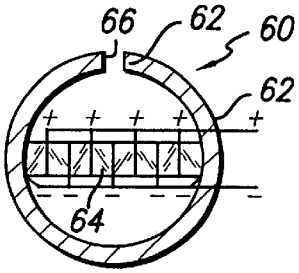
FIG. 6 is a sectional view of a fourth transducer which includes the cryogenically treated ceramic as the transducer member, and which may include the harmonic-rich alternating voltage shown in FIG. 2, to obtain a further preferred embodiment of the invention for providing an enhanced recovery of oil from the earth at a position below the earth's surface.

FIG. 6 illustrates another preferred embodiment of a transducer, generally indicated at 60, constituting a preferred embodiment of the invention. The embodiment shown in FIG. 6 is not as advantageous as the embodiment shown in FIG. 5 since it does not produce as much mechanical energy from a given amount of electrical energy as the embodiment shown in FIG. 5. However, the embodiment shown in FIG. 6 is less expensive to manufacture than the embodiment shown in FIG. 5 since it is easier to stack the cryogenically treated sectionalized elements radially in FIG. 6 than to stack the sectionalized transducer elements circumferentially as shown in FIG. 5.

The embodiment shown in FIG. 6 includes a support member 62 corresponding to that shown in FIG. 5 and further includes cryogenically treated sectionalized transducer elements 64. In the embodiment shown in FIG. 6, the cryogenically treated sectionalized transducer elements 64 are linearly stacked in abutting relationship to one another and the cryogenically treated sectionalized transducer elements at the ends of the stack are attached to the inner wall of the support member 62 at diametrical positions equally spaced from an opening or gap 66 in the support member 64. Thus, when alternating voltages are introduced to the cryogenically treated sectionalized transducer elements 64, the elements vibrate and produce vibrations in the support member 62. The vibrations of the support member 62 at positions adjacent to the opening or gap 66 in FIG. 6 are similar to the vibrations of the support member 42 adjacent to the opening or gap 46 in FIG. 5.

The preferred embodiment shown in FIG. 6 is similar to that shown in FIG. 2 of U.S. Pat. No. 4,651,044 except that the sectionalized transducer elements in FIG. 2 of U.S. Pat. No. 4,651,044 are not cryogenically treated. Furthermore, the sectionalized transducer elements 64 in FIG. 6 of this application preferably receive an alternating voltage rich in harmonics (e.g. square wave).

An embodiment of another preferred transducer of the invention is generally indicated at 70 in FIG. 7. The transducer member 70 includes a cryogenically treated transducer member 72 having an opening or gap 74 and a support member 76 having an opening or gap 78. The cryogenically treated transducer member 72 and the support member 76 may respectively correspond to the transducer member 12 and the support member 16 in FIG. 1. The transducer 70 may also constitute a preferred embodiment of the invention when it is energized by a harmonic rich voltage waveform such as shown at 30 in FIG. 2. The transducer 70 is similar to the transducer shown in FIG. 1 of U.S. Pat. No. 5,122,992 except that the transducer member in FIG. 1 of U.S. Pat. NO. 5,122,992 is not cryogenically treated and it is not subjected to a voltage rich in harmonics (e.g. square wave voltage).

A closure member 80 may be suitably attached, as by welding, to the support member 76 at the opposite ends of the gap 78. The closure member 80 may be disposed (in section) in a U-shaped configuration which extends into the space within the looped configurations defined by the cryogenically treated transducer member 72 and the support member 76. The closure member 80 may be made from a suitable material having spring-like properties so that the cryogenically treated transducer member 72 and the support member 76 will be able to vibrate when the transducer member receives electrical energy. For example, the closure member 80 may be made from a 413 alloy steel tempered to withstand approximately 130 psi to approximately 140 psi. The opposite axial ends of the transducer 70 may be closed by end caps as indicated in FIG. 2 of U.S. Pat. No. 5,122,992. The distance of the extension of the closure member 80 into the space within the looped configuration of the cryogenically treated transducer member 72 may be varied as shown in the drawings in U.S. Pat. No. 5,122,992.

FIG. 8 is an enlarged sectional view of another transducer, generally indicated at 90, to constituting another preferred prior art embodiment. The transducer 90 includes a cryogenically treated transducer member 92 and a support member 94 respectively corresponding to the cryogenically treated transducer member 12 and the support member 16 shown in FIG. 1. The transducer 90 constitutes a preferred embodiment of the invention when the transducer member 92 is cryogenically treated. The transducer 90 may also constitute a preferred embodiment of the invention when the cryogenically treated transducer member 92 is energized by the harmonic-rich waveform voltage shown in FIG. 2.

Sockets 96 are provided in the outer periphery of the support member 94. The sockets 96 preferably extend only partially through the thickness of the support member 94. In this way, the sockets 96 tend to make the support member 94 thinner at the positions of the sockets. The sockets 96 are shown in FIG. 8 as being disposed at spaced positions on the complete periphery of the support member 94. However, the sockets 96 can be disposed only at positions adjacent an opening or gap 98 in the support member or at any other portion of the peripheral surface of the support member. The sockets 96 may be filled or partially filled with a suitable material 100. Preferably the material 100 is compliant and has a weight per unit of area less than that of the material of the support member 94. For example, the material 100 may be a urethane or polyurethane. As will be appreciated, some, but not necessarily all, of the sockets 96 may be filled with the material 100.

The sockets 96 provide certain advantages when included on the periphery of the support member 94. They decrease the weight of the transducer 90. They also tend to control the fundamental frequency at which the transducer 90 resonates. As will be appreciated, the number of the sockets 96 in the support members 94 and the disposition of the sockets in the support member will affect the fundamental frequency at which the transducer 90 resonates. The inclusion of the material 100 in the sockets 96 also affects the fundamental frequency at which the transducer 90 resonates.

The embodiment generally indicated at 101 in FIG. 9 is similar in a number of respects to the embodiment shown in FIG. 8. However, instead of providing the sockets 96 in the support member 92 as in FIG. 8, a support member 102 is provided with grooves 104 extending axially along the length of the support member. The grooves 104 may be filled with a suitable material 106 such as urethane or polyurethane. The grooves 104 and the material 106 provide the same advantages as described above for the embodiment shown in FIG. 8. This is even true with respect to the control of frequency in the transducer 101 since the relative disposition of the grooves 102 controls the vibrational frequency of the transducer in a manner similar to that described above for the embodiment shown in FIG. 8.

The embodiment shown in FIG. 9 and described in the previous paragraph is similar in a number of respects to the embodiment shown in FIGS. 3 and 4 of U.S. Pat. No. 5,020,035. However, the embodiment in FIGS. 3 and 4 of U.S. Pat. No. 5,020,035 does not include a cryogenically treated transducer member and the transducer member does not receive a voltage rich in harmonics (e.g. a square wave voltage).

The embodiment generally indicated at 108 in FIG. 10 includes a compliant material 110 such a urethane or a polyurethane within the hollow interior of a cryogenically treated transducer member 114. The compliant material 110 may be suitably bonded to the interior surface of the cryogenically treated transducer member 114 included in the transducer 108. Air chambers or cavities 116 may be provided in the material 110 at spaced positions. The air chambers or cavities 116 extend axially through the compliant material 110. End caps made from a suitable material such as a urethane may plug the end of the hollow interior of the transducer 112.

FIG. 11 illustrates an embodiment and which is generally indicated at 119. The embodiment 119 includes a pair of transducers, generally indicated at 120 and 122, each of which may have a construction corresponding to the construction shown in FIG. 1 of this application or corresponding to that shown in any of the Figures of this application. As will be seen, the transducer 120 has a smaller size than the transducer 122 so that it can be disposed within the transducer 122 in a substantially concentric relationship with the transducer 122. Bracing members such as a member 124 extend between the openings or gaps in the transducers 120 and 122 to hold the transducers in a fixed relationship with each other. The bracing members 124 are attached at opposite ends to the support members in each of the transducers 120 and 122.

Preferably the transducers 120 and 122 vibrate at substantially the same fundamental frequency. This can be accomplished by carefully selecting the parameters of the support members in the transducers 120 and 122. Since the transducer 120 and 122 vibrate at substantially the same frequency, the vibrations from one reinforce the vibrations from the other. As a result, the amplitudes of the vibrations from the transducers 120 and 122 are significantly enhanced.

It will be appreciated that the transducer member can be removed from the transducer 120 so that only the support member is provided. This is shown in FIG. 7 of U.S. Pat. No. 5,020,035 and is incorporated in this application by reference to the '035 patent. This support member reinforces the support member in the transducer 122, particularly in view of the bracing action provided by the members 124. This prevents the transducer 122 from cracking at the weak points. Because of this, the amplitudes of the vibrations in the transducer assembly 122 can be significantly increased without damaging the transducer.

The embodiment shown in FIG. 11 is similar in a number of respects to an embodiment shown in FIGS. 9 and 10 of U.S. Pat. No. 5,020,035. However, the embodiment shown in FIGS. 9 and 10 of U.S. Pat. No. 5,020,035 does not provide cryogenically treated transducer members and the transducer members do not receive an alternating voltage rich in harmonics (e.g. square wave voltage).

FIG. 12 is an enlarged sectional view of a preferred embodiment, generally indicated at 130, of a transducer assembly. The transducer assembly 130 includes a pair of transducers respectively indicated generally at 132 and 134. Each of the transducers may have a construction corresponding to that shown in FIG. 1 of this application or in any of the other Figures of this application. Thus, the transducer 132 may include a cryogenically treated transducer member 136 and a support member 138 and may further include openings or gaps 140 and 142 respectively in the transducer member and the support member. An electrically conductive coating 144 may be provided on the inner surface of the cryogenically treated transducer member 136 so that the coating of the transducer member and the support member 138 define a capacitor.

In like manner, the transducer 134 may include a cryogenically treated transducer member 146, a support member 148, a coating 150 on the inner surface of the cryogenically treated transducer member and openings or gaps 152 and 154 respectively in the transducer member and the support member. The support members 138 and 148 are bonded to each other as at 156 at the positions where they abut each other. In the abutting relationship, the openings or gaps 140 and 142 in the transducer 132 abut and are aligned with the gaps 152 and 154 in the transducer 134. An alternating voltage rich in harmonics, such as shown at 30 in FIG. 2, is applied between the support member 138 and the coating 144 and between the support member 148 and the coating 150. Preferably the voltages applied to the transducers 132 and 134 are in phase.

The transducers 132 and 134 are effectively connected electrically in parallel and in a synchronous relationship with each other. This causes the capacitances defined in the transducers 132 and 134 to be in parallel with each other. This in turn causes the electrical current in the transducers 132 and 134 to be doubled in comparison to the electrical current in each of the transducers as a separate unit. The effective doubling of the current in the transducer assembly 130 increases the amplitude of the vibrations in the transducer assembly. This enhances the effectiveness of the transducer assembly 130 in separating the fluid such as oil from the earth in which the oil is located and in recovering the oil.

In measurements made by applicant on the transducer assembly 130, applicant has found that the transducer assembly 130 is as much as four (4) times as effective as the transducer 132 or the transducer 134 when the transducers operate separately. As will be appreciated, this is approximately twice as great as the increase in the value of the capacitances in the transducers 132 and 134 as a result of the connection of these capacitances in parallel. This increase in effectiveness does not consider the increase in the effectiveness of the transducer assembly 130 as a result of the use of the harmonic-rich voltage 30 such as shown in FIG. 2.

The transducer assembly 130 also has other advantages over the prior art. This results from the fact that the lower half of the transducer assembly 130 tends to produce forces in a downward direction and that the upper half of the transducer assembly tends to produce vibratory forces in an upward direction. These vibratory forces tend to cancel each other. This is particularly true since the downward vibratory forces produced by the lower half of the transducer assembly 130 and the upward vibratory forces produced by the upper half of the transducer assembly are somewhat limited by the action of the bond 156.

As will be appreciated, vibratory forces are primarily desired in the horizontal direction in FIG. 12 outwardly from the transducers 132 and 134. Since the vertical components of the vibratory forces in the transducers 132 and 134 tend to be canceled by the coupling of the transducer by the bond 156, the result in the transducer assembly 130 is that the vibratory energy in the transducer assembly 130 is primarily outwardly in the horizontal direction. This may explain, at least in part, why the transducer assembly 130 is as much as four (4) times more effective than when the transducer 132 or the transducer 134 is operated separately.

The transducer 130 is similar in a number of respects to the transducer shown in FIGS. 1 and 2 of U.S. Pat. No. 5,592,359 issued on Jan. 7, 1997, for a "Transducer" to the applicant of this invention. However, the transducer in FIGS. 1 and 2 of U.S. Pat. No. 5,592,359 does not include cryogenically treated transducer members and the transducer members do not receive an alternating voltage rich in harmonics (e.g. square wave voltage).

Figure 13:
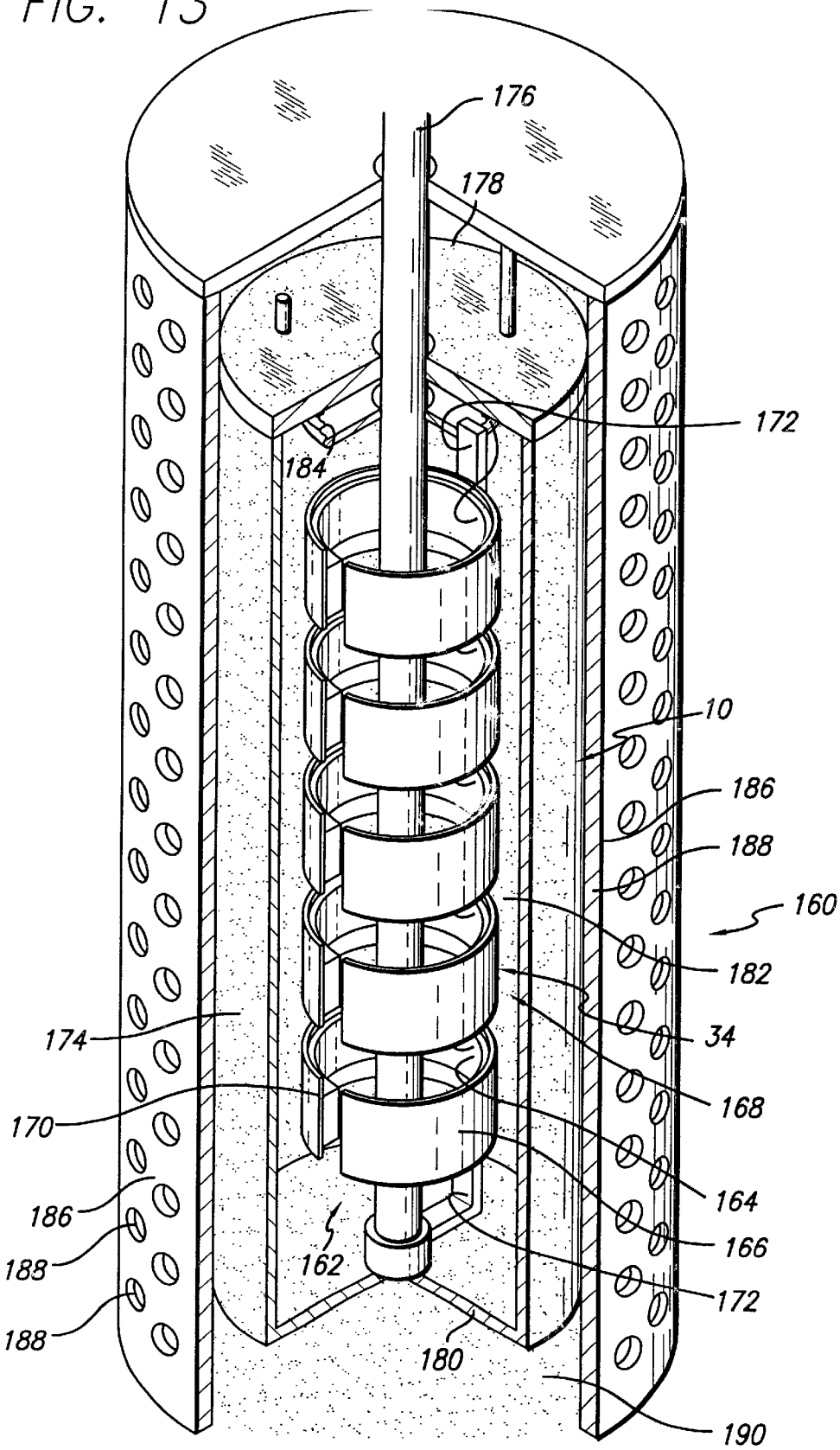
FIG. 13 is a sectional view of an eleventh transducer which includes the cryogenically treated ceramic as the transducer member, and which may include the harmonic-rich alternating voltage shown in FIG. 2, to obtain a still another a preferred embodiment of the invention for providing an enhanced recovery of oil from the earth at a position below the earth's surface.

FIG. 13 is a perspective view of a preferred embodiment of a transducer assembly, generally indicated at 160. The transducer assembly 160 includes one or a plurality of transducers. When a plurality of transducers are provided, each may have a construction which is shown is FIG. 1 or any other of the Figures in this application. For example, a transducer generally indicated at 162 may include a cryogenically treated transducer member 164 and a support member 166 such as shown in FIG. 1. The opening or gap in each transducer does not have to be aligned with the opening or gap in any of the other transducers. For purposes of simplification, only the transducer 162 and a transducer generally indicated at 168 are shown in FIG. 13.

The support member 166 may be clamped at a position which is preferably diametrically opposite a slot 170 in the support member. The clamping may be provided by a mounting rod 172 which is suitably attached to a tubing or sleeve 174. The tubing 174 may be disposed in a concentric relationship with the transducer members 164 and 168 and may be spaced from the support member. The tubing 174 is preferably made from a suitable metal such as aluminum or stainless steel.

A support rod 176 extends axially through the tubing 174 and the cryogenically treated transducer members in the transducers 162 and 168. The rod 176 may be dependent from the bottom of a pump (not shown). End plates 178 are disposed at the opposite end of the tubing 174 and are coupled to the mounting rod 172 and the rod 176 to provide a support of the tubing 174. The tubing 174 is preferably filled with an oil 182 such as a silicon oil. The oil may be provided with characteristics to lubricate the different parts and to communicate vibrations from the transducers 162 and 168 to the tubing 174.

A bellows 184 is preferably disposed adjacent the upper end plate 178. The bellows 184 expands or contracts with changes in temperature to provide a compensation within the tube 174 for changes in the space occupied by the oil 182 in accordance with such changes in temperature and pressure. A casing 186 envelopes the tubing 172. The casing 186 may be perforated as indicated at 188 to provide for the passage of oil 190 from a position outside of the casing 186 through the perforations into the space between the tubing 174 and the casing 186. The oil 190 in the casing 186 accordingly functions to transmit to the casing the vibrations produced in the transducers such as the transducers 162 and 168.

When electrical energy is applied to the transducers such as the transducers 162 and 168, the transducers produce vibrations. These vibrations are transmitted to the tubing 174 to produce vibrations of the tubing in the "hoop" or radial mode and are then transmitted to the casing 186 through the oil 190 in the casing. The casing 186 accordingly vibrates in the "hoop" or radial mode. This produces a flow of the oil 190 into the casing 186 from the earth surrounding the casing.

The transducer assembly 60 is similar in a number of respects to the transducer assembly shown in FIGS. 1 and 2 of U.S. Pat. No. 4,658,897 issued to applicant and other inventors on Apr. 27, 1987 for a "Downhole Transducer System" and assigned of record to the assignee of record of this application. However, the transducer assembly of U.S. Pat. No. 4,058,897 does not include cryogenically treated transducer members and the transducer members do not receive voltages rich in harmonics (e.g. square wave voltages).

The preferred embodiments of the transducer of this invention provide certain important advantages over the prior art. They provide transducer members made from cryogenically treated ceramics. The cryogenically treated ceramics provide enhanced dielectric strengths which cause the ceramics to withstand increased voltages without cracking. The transducers are also advantageous because alternating voltages rich in harmonics (e.g. square wave voltage) are applied to the ceramics to increase the power output from the transducers. The combination of the ceramics with the enhanced dielectric constants and the application of increased power to the ceramics causes the separation of oil from the surrounding earth and the recovery of the oil from the earth to be enhanced.

Although this invention has been disclosed and illustrated with reference to particular preferred embodiments, the principles involved are susceptible for use in numerous other embodiments which will be apparent to persons of ordinary skill in the art. The invention is, therefore, to be limited only as indicated by the scope of the appended claims.

What is claimed is:

1. A method of recovering oil from the earth at positions below the surface of the earth, including the steps of:

providing a transducer formed from (a) a cryogenically treated ceramic having a looped configuration and having a gap in the looped configuration and having properties of vibrating in accordance with the introduction of an alternating voltage to the ceramic and (b) a support member having a looped configuration enveloping the ceramic and having properties of vibrating with the ceramic and having a gap at the position of the gap in the ceramic, and applying an alternating voltage to the ceramic to produce vibrations of the ceramic and a recovery of oil as a result of the vibrations when the transducer is disposed in the earth.

2. A method as set forth in claim 1 wherein the cryogenically treated ceramic is selected from a group consisting of polycrystalline lead titanate and polycrystalline lead zirconate and wherein the support member is made from a metal.

3. A method as set forth in claim 1 wherein the support member is bonded to the cryogenically treated ceramic.

4. A method as set forth in claim 1 wherein the cryogenically treated ceramic and the support member are cylindrical with hollow interiors and wherein the support member is disposed on the cylindrical surface of the cryogenically treated ceramic and is bonded to the cylindrical surface of the cryogenically treated ceramic.

5. A method as set forth in claim 4 wherein the cryogenically treated ceramic is provided with a pair of legs separated by the gap and wherein the alternating voltage is applied to the legs to produce vibrations of the legs.

6. A method as set forth in claim 5 wherein the ceramic is cryogenically treated by cooling the ceramic to a temperature of approximately −100° C. and then transferring the ceramic to liquid nitrogen for a time to receive a temperature of approximately the temperature liquid nitrogen and by thereafter cooling the ceramic gradually to approximately room temperature and wherein a voltage rich in harmonics is applied to the cryogenically treated transducer member.

7. A method as set forth in claim 1 wherein the ceramic is cryogenically treated by cooling the ceramic to a temperature of approximately −100° C., then transferred to liquid nitrogen for a time to receive a temperature of approximately the temperature of liquid nitrogen and thereafter cooled gradually to room temperature.

8. A method as set forth in claim 7 wherein a voltage rich in harmonics is applied to the cryogenically treated transducer member.

9. A method as set forth in claim 1 wherein the thickness of the support member progressively increases with progressive distances from the gap in the support member to positions on the cryogenically treated ceramic opposite the gap.

10. A method as set forth in claim 9 wherein the support member is provided with axially extending grooves at annularly spaced positions in the external surface of the support member.

11. A method as set forth in claim 10 wherein a compliant material is disposed in at least some of the grooves in the support member.

12. A method as set forth in claim 1 wherein a closure member is disposed in the gaps in the cryogenically treated ceramic and the support member and is extended into the space within the looped configuration of the cryogenically treated ceramic.

13. A method as set forth in claim 12 wherein the closure member is provided with a U-shaped configuration having an opening substantially at the position of the gaps and wherein the closure member is extended in a substantially radial direction into the space between the gaps in the cryogenically treated ceramic and the support member at one end and the positions on the cryogenically treated ceramic and the support member radially opposite the gaps at the other end.

14. A method as set forth in claim I wherein the transducer constitutes a first transducer and the cryogenically treated ceramic constitutes a first cryogenically treated ceramic and the support member constitutes a first support member and wherein a second transducer includes a second cryogenically treated ceramic and a second support member and wherein the first and second transducers have a substantially concentric relationship with the gaps in the transducers having a substantially aligned radial relationship and wherein bracing members extend between the gaps in the first and second transducers to retain the transducers in the substantially concentric relationship.

15. A method as set forth in claim 1 wherein the support member has an inner wall and wherein the cryogenically treated ceramic is formed from a plurality of sectionalized cryogenically treated ceramic elements in abutting relationship to one another one and to the inner wall of the support member.

16. A method as set forth in claim 15 wherein the sectionalized cryogenically treated ceramic elements of the cryogenically treated ceramic are circumferentially polarized.

17. A method as set forth in claim 16 wherein the sectionalized cryogenically treated ceramic elements are disposed in a radial direction between opposite ends of the support member at positions equally displaced from the gap in the support member at the opposite ends of the sectionalized cryogenically treated ceramic elements.

18. A method as set forth in claim 15 wherein the sectionalized cryogenically treated ceramic elements are disposed in a radial direction within the loop defined by the support member and are attached at their opposite ends to the support member and are equally spaced at their opposite ends from the gap in the support member.

19. A method as set forth in claim 15 wherein the transducer constitutes a first transducer member and the cryogenically treated ceramic constitutes a first cryogenically treated ceramic and the support member constitutes a first support member and wherein a second transducer has a second cryogenically treated ceramic and a second support member respectively corresponding to the first cryogenically treated ceramic and the first support member and wherein the first and second transducers have a substantially common plane and have an attachment of the first and second support members to maintain the first and second transducers in the substantially common plane.

20. A method as set forth in claim 19 wherein the second cryogenically treated ceramic and the second support member have gaps respectively corresponding to the gaps in the first cryogenically treated ceramic and the first support member and wherein the transducers are disposed in the common plane with the gaps in the transducers in an adjacent and aligned relationship and wherein the support members in the first and second transducers are attached to each other at the positions where the gaps in the first and second transducers are adjacent to each other.

21. A method as set forth in claim 1 wherein the transducer constitutes a first transducer and wherein at least one additional transducer is provided with characteristics corresponding to those of the first transducer and wherein the first transducer and the additional transducer are provided with planar characteristics and wherein the first transducer and the additional transducer are disposed with their planar characteristics in a spaced and substantially parallel relationship and wherein the first transducer and the additional transducer are maintained with the planar characteristics in the spaced and substantially parallel relationship.

22. A method as set forth in claim 21 wherein the first transducer and the additional transducer are fixedly disposed in a tubing and wherein the tubing is filled with fluid.

23. A method as set forth in claim 22 wherein the tubing is disposed in a casing and wherein the casing is perforated to provide for a passage of oil from the earth around the casing into the space between the casing and the tubing.

24. A method as set forth in claim 1 wherein a voltage rich in harmonics is applied to the ceramic.

25. A method as set forth in claim 1 wherein an alternating voltage with square wave characteristics is applied to the ceramic to produce vibrations of the transducer and the recovery of oil as a result of the vibrations when the transducer is disposed in the earth.

26. A method as set forth in claim 25 wherein the transducer has a particular resonant frequency and wherein the square wave signal has a fundamental frequency substantially corresponding to the resonant frequency of the transducer.

27. A method as set forth in claim 26 including the steps of initially subjecting the ceramic to a temperature of approximately −100° C. to cool the ceramic to this temperature;

subsequently disposing the ceramic in liquid nitrogen to cool the ceramic to approximately the temperature of the liquid nitrogen; and thereafter gradually bringing the temperature of the ceramic to approximately room temperature.

28. A method as set forth in claim 27 wherein the ceramic is initially formed, before the cooling of the ceramic, with a looped configuration and with a gap in the looped configuration and is provided with the properties of vibrating in accordance with the introduction of an alternating voltage to the ceramic.

29. A method as set forth in claim 27 wherein the ceramic is formed from a group constituting of polycrystalline lead titanate and polycrystalline lead zirconate.

30. A method as set forth in claim 27 wherein a support member is disposed on the ceramic after the ceramic has cooled gradually to approximately room temperature.

31. A method as set forth in claim 27 wherein the transducer member is formed from a plurality of sectionalized transducer elements attached to the circumferential inner surface of the support member.

32. A method as set forth in claim 27 wherein the transducer member is formed from a plurality of radially disposed sectionalized transducer elements and wherein the sectionalized transducer elements disposed in the plurality at the outer radial ends of the transducer member are attached to the support member at positions equally spaced from the gap in the support member.

33. A method as set forth in claim 27 wherein a closure member made from a resilient material is provided with an opening at one end and is closed at the other end and wherein the closure member is attached at the open end to the support member at the position of the gap in the support member and wherein the closure member is disposed at its closed end in the space within the cylindrical configuration of the transducer member.

34. A method as set forth in claim 27 wherein sockets are disposed in the support member.

35. A method as set forth in claim 27 wherein at least one groove is disposed in the support member.

36. A member as set forth in claim 35 wherein a compliant material at least partially fills the at least one groove in the support member.

37. A method as set forth in claim 27 wherein the transducer has a cylindrical configuration and wherein compliant material is disposed within the cylindrical configuration of the transducer member.

38. A method as set forth in claim 37 wherein openings are provided in the compliant material within the cylindrical configuration of the transducer member.

39. A method as set forth in claim 27 wherein the transducer constitutes a first transducer and wherein a second transducer having a smaller size than, but substantially the same construction as, the first transducer is disposed within the first transducer in a substantially concentric relationship with the first transducer and wherein the first and second transducers are attached to each other to maintain the substantially concentric relationship between the transducers and wherein the alternating voltage is applied to the second transducer.

40. A method as set forth in claim 27 wherein a second support member having a smaller size than the support member in the transducer is disposed within the transducer in a substantially concentric relationship with the transducer and wherein the second support member is attached to the support member in the transducer to maintain the support members in the substantially concentric relationship.

41. A method as set forth in claim 27 wherein the transducer constitutes a first transducer and the transducer member constitutes a first transducer member and the support member constitutes a first support member and wherein a second transducer has a second transducer member and a second support member respectively corresponding in construction to the construction of the first transducer member and the first support member in the first transducer and wherein the first and second transducers are attached to each other in a substantially planar relationship and wherein the alternating voltage is applied to the second transducer member.

42. A method of extracting oil from areas below the surface of the earth, including the steps of:

providing a transducer member made from a ceramic material disposed in a loop and having properties of vibrating upon an application of an alternating voltage to the transducer member and having a gap in the loop, cryogenically treating the ceramic transducer member, providing a support member disposed in a loop and having a gap in the loop, disposing the support member on the cryogenically treated transducer member with the gap in the support member aligned with the gap in the transducer member, and applying to the transducer member an alternating voltage to obtain vibrations of the transducer member and the support member.

43. A method as set forth in claim 42 including the steps of disposing the inner surface of the support member on the outer surface of the cryogenically treated member, and bonding the inner surface of the support member on the outer surface of the transducer member.

44. A method as set forth in claim 42 wherein the ceramic transducer member is selected from a group consisting of polycrystalline lead titanate and polycrystalline lead zirconate.

45. A method as set forth in claim 42 wherein the ceramic transducer member is gradually cooled to a temperature of approximately −100° C. and is then cooled in liquid nitrogen to approximately the temperature of liquid nitrogen and is thereafter returned gradually to approximately room temperature.

46. A method as set forth in claim 42 wherein the transducer member and the support member are cylindrical and wherein the cryogenically treated transducer member is provided with a substantially uniform thickness throughout its annular periphery and the support member is provided with a substantially uniform thickness throughout its annular periphery.

47. A method as set forth in claim 46 wherein sockets are disposed in the support member and wherein at least some of the sockets are at least partially filled with a compliant material.

48. A method as set forth in claim 42 wherein the transducer member and the support member are cylindrical and wherein the cryogenically treated transducer member is provided with a substantially uniform thickness throughout its annular periphery and the support member is provided with a progressively increasing thickness at progressive distances in opposite annular directions from the gap.

49. A transducer, including, a cryogenically treated ceramic having a hollow substantially looped configuration and having a gap in the hollow substantially looped configuration and having properties of vibrating in accordance with the introduction of an alternating voltage to the ceramic, a support having a substantially looped configuration and disposed on the cryogenically treated ceramic and covering the substantially looped configuration of the cryogenically treated ceramic and having a gap at a position corresponding to the gap in the ceramic, and a source of alternating voltage connected to the cryogenically treated ceramic to produce vibrations of the cryogenically treated ceramic and a recovery of oil as a result of the vibrations when the transducer is disposed in the earth.

50. A transducer as set forth in claim 49 wherein the hollow looped configuration of the cryogenically treated ceramic is defined by outer and inner cylindrical configurations to define a thickness for the cryogenically treated ceramic and wherein the support is disposed on the outer cylindrical configuration of the cryogenically treated ceramic and is defined by outer and inner cylindrical configurations.

51. A transducer as set forth in claim 50 wherein the inner cylindrical configuration of the support is bonded to the outer cylindrical configuration of the cryogenically treated ceramic.

52. A transducer as set forth in claim 49 wherein the ceramic and the support are cylindrical and wherein the ceramic and the support are provided with substantially uniform thicknesses.

53. A transducer as set forth in claim 49 wherein the ceramic and the support are cylindrical and wherein the ceramic is provided with a substantially uniform thickness and the support is provided with progressively increasing thicknesses at progressive distances from the gap in the support.

54. A transducer as set forth in claim 49 wherein the alternating voltage has substantially square ware characteristics.

55. A method of extracting oil from areas below the surface of the earth, including the steps of:

providing a ceramic transducer member in a loop, the ceramic transducer member having properties of vibrating upon an application of an alternating member to the transducer and having a gap in the loop, cryogenically prestressing the ceramic transducer to increase the dielectric strength of the ceramic transducer member, thereby providing for the ceramic transducer member to receive increased alternating voltages without cracking, and disposing a support member on the cryogenically prestressed ceramic transducer to enhance the strength of the cryogenically prestressed ceramic transducer member against cracking.

56. A method as set forth in claim 55, including the step of:

applying to the cryogenically prestressed transducer member an alternating voltages to obtain vibrations of the transducer member and the support member.

57. A method as set forth in claim 56 wherein the ceramic transducer is made from a material selected from the group consisting of polycrystalline lead titanate and polycrystalline lead zirconate and wherein the support member is disposed on the cryogenically prestressed ceramic transducer member and is provided with a gap at the position of the gap in the cryogenically prestressed ceramic transducer member.

58. A method as set forth in claim 57 wherein the support member has a substantially uniform thickness at progressive positions around the loop.

59. A method as set forth in claim 57 wherein the support member has a progressively increasing thickness at progressive positions displaced from the gap in the support member.

60. A method as set forth in claim 55 wherein the alternating voltages is rich in harmonics.

61. A method as set forth in claim 55 wherein the ceramic transducer member is made from a material selected from the group consisting of polycrystalline lead titanate and polycrystalline lead zirconate.

* * * * *

UNITED STATES PATENT AND TRADEMARK OFFICE

CERTIFICATE OF CORRECTION

PATENT NO. : 6,491,095 B2
DATED : December 10, 2002
INVENTOR(S) : Kompanek

It is certified that error appears in the above-identified patent and that said Letters Patent is hereby corrected as shown below:

Column 1,
Line 37, change "09/746,849" to read -- 09/716,849 --

Signed and Sealed this

Thirteenth Day of May, 2003

JAMES E. ROGAN
*Director of the United States Patent and Trademark Office*